US011530677B1

(12) United States Patent
Ganley

(10) Patent No.: US 11,530,677 B1
(45) Date of Patent: Dec. 20, 2022

(54) ISOLATION VALVE FOR SPARK-IGNITION PISTON ENGINES

(71) Applicant: James T Ganley, St. Paul, MO (US)

(72) Inventor: James T Ganley, St. Paul, MO (US)

(73) Assignee: James T. Ganley, St. Paul, MO (US)

( * ) Notice: Subject to any disclaimer, the term of this patent is extended or adjusted under 35 U.S.C. 154(b) by 0 days.

(21) Appl. No.: 17/751,718

(22) Filed: May 24, 2022

(51) Int. Cl.

| | |
|---|---|
| ***F02P 15/00*** | (2006.01) |
| ***F01M 11/02*** | (2006.01) |
| ***F02M 21/02*** | (2006.01) |
| ***F01N 13/10*** | (2010.01) |

(52) U.S. Cl.
CPC ..... *F02P 15/001* (2013.01); *F01M 11/02* (2013.01); *F01N 13/10* (2013.01); *F02M 21/023* (2013.01)

(58) Field of Classification Search
CPC .. F01N 13/10; F01M 11/02; F01M 2011/026; F02M 21/023; F02M 21/0215; F02M 21/0245; F02M 21/0218; F02M 21/0242; F02M 35/10216; F02M 37/0023; F02P 15/001
See application file for complete search history.

(56) References Cited

U.S. PATENT DOCUMENTS

| | | | | |
|---|---|---|---|---|
| 7,568,472 | B2 * | 8/2009 | Woody | F02M 7/12 123/517 |
| 10,087,889 | B2 * | 10/2018 | Hayatani | F04B 17/04 |
| 11,415,027 | B1 * | 8/2022 | Ganley | F01L 7/026 |
| 2003/0041818 | A1 * | 3/2003 | Cobb, Jr. | F02M 37/0023 123/73 V |
| 2007/0272218 | A1 * | 11/2007 | Woody | F02M 7/12 123/517 |

* cited by examiner

*Primary Examiner* — Audrey B. Walter
*Assistant Examiner* — Dapinder Singh

(57) ABSTRACT

A valve comprising a stationary shell and a rotatable annular core is designed for installation on the block deck of a spark-ignition piston engine, with there being one valve installed on the engine's block for every cylinder in the block. Rotation of the annular core cyclically opens and closes the ignition pathway(s) extending between the internal volume of the valve's associated cylinder and the spark plug(s) initiating combustion within the cylinder, with the pathway(s) only being open during time intervals wherein the spark plug(s) are electrically activated as part of the engine's normal operating cycle. Control of the open-closed status of the ignition pathway(s) eliminates engine pre-fire events caused by hot points on the spark plug(s). The valve also provides improved technology for directing and regulating the flow of fuel, oxidant, and exhaust gases as they are transferred into and out of the valve's associated cylinder.

3 Claims, 8 Drawing Sheets

ISOLATION VALVE FOR SPARK-IGNITION PISTON ENGINES

BACKGROUND OF THE INVENTION

This invention relates generally to a valve that installs on the block deck of a spark-ignition piston engine, with there being one valve installed on the engine's block for each cylinder in the block. Specifically, this invention relates to a valve comprising an annular core whose rotation cyclically opens and closes the ignition pathway(s) extending between the internal volume of the valve's associated cylinder and the spark plug(s) initiating combustion within the cylinder. (An "ignition pathway" is a channel wherein a combustion flame front may propagate unimpeded by physical barriers.)

The preferred embodiment of the present invention is a valve that can be installed on, and operated with, an engine wherein the combustion process in each cylinder is initiated by multiple spark plugs. An alternative embodiment of the invention is a valve that operates with an engine whose cylinders have only one associated spark plug. This specification discloses the present invention primarily in terms of a valve design that is compatible with the preferred embodiment. The above-mentioned alternative embodiment is disclosed as a limiting case of the preferred embodiment.

The present valve opens and closes ignition pathways that connect the internal volume of a cylinder to its associated spark plugs. The pathways transition from closed-to-open immediately before the spark plugs are electrically activated as part of the engine's normal operating cycle; the pathways transition from open-to-closed after combustion of the fuel-oxidant charge in the cylinder is underway. This type of control of the open-closed status of ignition pathways prevents engine pre-fire events caused by hot points on the spark plugs' electrodes. Pre-fire events are especially problematic when the engine's fuel has a low ignition energy, as is the case with gaseous hydrogen, which is an important renewable energy carrier. In addition to eliminating engine pre-fire events, the present valve also provides improved technology for guiding, regulating, and temporally controlling the flow of fuel, oxidant, and exhaust gases as they are transferred into and out of the cylinders of a piston engine.

In this specification, the engine on which a valve is installed is referred to as the "valve's associated engine." The cylinder with which a valve interacts is referred to as the "valve's associated cylinder." A piston which moves within a cylinder is referred to as the "cylinder's associated piston," and vice versa. The spark plugs that initiate combustion within a cylinder are referred to as the "cylinder's associated spark plugs," and vice versa.

By way of background, it is noted that all internal combustion engines brought into service during the past 150 years or so have had operating cycles that include an oxidant or a fuel-oxidant compression process. Compression of a gaseous oxidant or a gaseous fuel-oxidant mixture prior to combustion provides the capability for large expansion ratios for the combustion products, and larger expansion ratios are directly associated with more efficient engines. However, the high temperatures produced by these near-adiabatic compression processes impose severe constraints on engine design. For example, compression ratios in spark-ignition engines are constrained to be less than the auto-ignition limit of roughly 9:1 to 11:1, depending on fuel type. This limit exists because in-engine (near adiabatic) compression ratios greater than the auto-ignition limit can result in engine knocking. Similarly, compression ratios in compression-ignition engines are constrained to be less than the diesel-compression limit of roughly 20:1 to 23:1. This limit exists because in-engine compression ratios greater than the diesel-compression limit can produce extremely high thermal and mechanical stresses in engine components, and they can also produce unacceptably high levels of $NO_x$ emissions. These thermal, mechanical, and thermochemical design constraints limit the compression and expansion ratios which can be practicably realized, and this in turn limits the efficiency of engines utilizing the near-adiabatic in-engine compression processes that are executed concurrently with engine operation.

As a solution to compression-related problems in piston engines, U.S. Pat. No. 10,352,233 (Ganley, July 2019) reveals a high-efficiency two-stroke engine which does not have a compression process in its operating cycle, and is therefore not performance-limited by the in constraints mentioned the previous paragraph. The engine revealed in the referenced patent relies on supplies of high-pressure fuel and oxidant gases that are delivered at ambient temperature from external reservoirs. Compression of the fuel and oxidant gases stored in the reservoirs is done in an isothermal or nearly isothermal manner in order to reduce the amount of energy used in the compression process. After compression, the gases are stored—perhaps for days, weeks, or even months—and then delivered to the engine at ambient temperature.

Best performance of the engine revealed in U.S. Pat. No. 10,352,233 is achieved when the cylinders' fuel and oxidant flow passages are capable of transitioning from a closed status to an open status and then back to a closed status during a crankshaft rotation of only a few degrees. Also, the relative timing of opening and closing fuel, oxidant, and exhaust flow passages must be coordinated to a precision of a few tenths of a degree of crankshaft rotation. Camshaft-driven poppet valves currently used in piston engines are incapable of this transition speed or this high level of precision.

U.S. patent application Ser. No. 17/232,885 (Ganley, April 2021) reveals a valve capable of managing the demanding fuel, oxidant, and exhaust gas flow requirements of the engine disclosed in U.S. Pat. No. 10,352,233. The valve has a stationary shell and an annular core which is rotatable within the shell. Both the shell and the annular core have through penetrations, with the penetrations being situated so that a 360-degree rotation of the annular core causes its penetrations to sequentially align with specific shell penetrations. This temporary alignment of shell and core penetrations creates, in a precisely ordered temporal sequence, high conductance flow passages that extend completely through the valve, thereby sequentially joining the upper ports of the valve's fuel, oxidant, and exhaust flow passages to the internal volume of the associated cylinder. (The word "penetration" is used in the referenced application—and in this specification—to refer to a hole which passes completely through a solid object, with the cross-sectional area of the hole being in the shape of an annulus sector.)

In the above-referenced application, and in the present specification, the word "upper" is used to designate a valve feature that is farther from the block deck of the valve's associated engine than some related feature. Similarly, word "lower" refers to a valve feature that is closer to the block deck of the valve's associated engine than a related feature. For example, in the present specification, the upper ports of the valve's flow passages are said to be farther from the associated engine's block deck than the lower ports. Also, in the present specification the words "up" and "upward" and the words "down" and "downward" refer, respectively, to directions that are away from or towards the block deck of the valve's associated engine.

Because the shell and core penetrations in the valve of U.S. patent application Ser. No. 17/232,885 have the shape of annulus sectors, the closed-open-closed transitions executed by the valve can be accurately established for both very short and very long time intervals. This is because the dimensions and relative locations of the valve's penetrations can be machined with great precision, meaning that both the relative and absolute timing of the valve's closed-to-open and open-to-closed transitions can be controlled to within a few tenths of a degree of crankshaft rotation. This capability, which is carried forward to the design of the present valve, provides enabling technology for the two-stroke piston engine revealed in U.S. Pat. No. 10,352,233.

Even though the valve revealed in the above-referenced application provides enabling gas flow control for an important engine type, it does not address one other problem that is present to some degree in all spark-ignition piston engines, namely, the problem of engine pre-fire events caused by hot points on the electrodes of spark plugs. The valve in the referenced application has one centrally located hole which provides the mounting location for a spark plug that is continuously exposed to the internal volume of the associated cylinder. This continuous exposure of the cylinder's associated spark plug greatly increases the probability of engine pre-fire events.

The primary objective of the present invention is to provide a valve which eliminates engine pre-fire events that are caused by hot points on spark plug electrodes. The present valve achieves that objective by maintaining a mechanical barrier between a cylinder's fuel-oxidant charge and the spark plugs that initiate combustion of the charge, with the barrier only being removed during the time interval wherein the spark plugs are electrically activated as part of the engine's normal operating cycle. The valve also provides improvements to prior art technology for spatially directing and temporally regulating the flow of fuel, oxidant, and exhaust gases as they move into and out of the cylinders of piston engines.

BRIEF SUMMARY OF THE INVENTION

The design of the present valve enables its installation on, and operation with, a specific engine type that is referred to herein as the "target engine." The target engine is characterized as having commonality with features of the engine revealed in U.S. Pat. No. 10,352,233, except that the target engine may have N (N=1, 2, 3, 4 . . . ) symmetrically positioned spark plugs associated with each of its cylinders, rather than just one spark plug per cylinder as is the case for the engine revealed in the referenced patent. (The term "symmetrically positioned" refers to an azimuthal symmetry about the central axis of the valve's associated cylinder.) The target engine is therefore seen to be an external-compression, spark-ignition, two-stroke engine with N (N=1, 2, 3, 4 . . . ) spark plugs dedicated to initiating the combustion process in each of the engine's individual cylinders. It is understood that valve designs for use with other types of spark-ignition piston engines, four-stroke engines for example, may be derived from the present valve design without departing from the essential features of the invention revealed herein. Those derived valve designs are recognized as embodiments of the present invention.

Engine designers have previously envisioned the use of multiple spark-spark plugs for individual cylinders in order to improve engine reliability through ignition redundancy or to improve engine efficiency through more uniform combustion of fuel. Generally, higher values of N have been suggested for engines with larger cylinder bores. Designs with as many as six spark plugs per cylinder have been suggested for large marine engines wherein cylinder bores can be on the order of one meter. However, these designs have never been implemented, in large part because of the simplicity and reliability of compression-ignition (diesel) engines. The engine revealed in U.S. Pat. No. 10,352,233 offers significant performance improvements relative to contemporary diesel engines, but it cannot use compression ignition because the engine's operating cycle has no compression process. Therefore, the engine must use spark ignition. In larger versions of the target engine, multiple spark plugs are clearly desirable. The additional capabilities offered by the present valve make multiple spark plugs a practical design option even for small-bore versions of the target engine.

The present valve comprises a shell which is fixed in location and orientation with respect to surrounding engine structure and an annular core which is rotatable within the shell. The rotatable annular core has the form of an annular disk, that is, the outer radius of the annular core is much greater than its thickness. Features of the valve's shell include (1) a baseplate which, at valve installation, is closely engaged with the associated engine's block deck, (2) an outer wall which encompasses the periphery of the baseplate, (3) an annular hub which extends above the upper surface of the baseplate, and (4) a cover plate which, at installation, is closely engaged with the upper surfaces of the central hub, the outer wall, and the annular core. (The term "closely engaged" is used herein to refer to two surfaces positioned so that a gas-tight seal can be maintained between them, either as a stationary seal utilizing a gasket, or as a rotating seal utilizing lubricant.)

Practical design considerations dictate that the valve's baseplate, its annular hub, and its outer wall are fabricated as one component, a component which is referred to herein as the "shell body." The shell body will be made by precision machining operations that are executed on a single metal plate or a single metal casting. The valve's cover plate, on the other hand, will of necessity be fabricated as a separate component, detachable from the shell body so as to facilitate placement of the annular core within the shell body during valve assembly. In the following discussions, the three main features of the shell body—baseplate, annular hub, and outer wall—are at times discussed as if they were separate items. However, it is to be understood that the three features relate to a single valve component fabricated from a single piece of metal, a component referred to as the shell body.

Assembly of the valve is accomplished by dropping the annular core down over the annular hub. This causes the inner curved surface of the annular core to become closely engaged with the outer curved surface of the annular hub. As the annular core is dropped into place, its lower planar surface becomes closely engaged with the upper planar surface of the baseplate. After the annular core is put in place, the valve's cover plate is placed over the top of the shell body, thereby causing the cover plate's lower planar surface to become closely engaged with the upper planar surface of the annular core, as well as with the upper planar surfaces of the outer wall and the annular hub, as was discussed above. With attachment of the valve's cover plate to the shell body, the valve's annular core becomes fully enclosed within the valve's shell. When valve assembly is complete, the annular hub and the annular core share a common axis referred to as the "valve axis."

Attachment of the shell body to the engine's block is achieved by aligning counter-bored through holes in the shell body with blind threaded holes in the engine's block. Socket-head bolts are inserted into the aligned holes and tightened in order to accomplish the attachment. Design of the valve is such that the relative locations of the counter-bored through holes in the shell body and the blind threaded holes in the engine's block cause the valve axis to coincide with the extended central axis of the valve's associated cylinder. When the assembled valve is installed and the engine is operating, the annular core rotates about the annular hub and, in so doing, rotates about the valve axis and the coincident central axis of the valve's associated cylinder.

The planar areas of contact between the annular core, the baseplate, and the cover plate all have circular corrugations that are centered on the valve axis. When the valve is assembled, the opposed corrugated surfaces become closely engaged. The corrugation peaks of each surface mesh with the corrugation valleys of the opposed surface. The corrugations provide greater surface area for conducting heat away from the baseplate and they provide greater integrity for the seals between the closely engaged surfaces. The corrugations also provide an interface between the surfaces which mitigates the unavoidable thrust forces generated by the eccentric mechanism forcing the rotation of the annular core.

Lubricant for the valve's rotating seals is supplied by an oil pump which draws oil from an in-engine reservoir (oil sump) and then drives it through an oil supply line to a gas-tight fitting installed on a central mounting hole in the cover plate. The valve design is such that, when the cover plate is attached to the shell body, its central mounting hole overlays the central volume of the valve's annular hub. (The central volume of the annular hub, or of any annulus, is the volume enclosed by its inner curved surface and two parallel planes defining its axial extent.) The oil pump forces lubricant into the annular hub's central volume. The lubricant then goes through radial oil galleries in the annular hub's walls and into axial grooves in the annular hub's outer curved surface. The axial grooves disperse the lubricant axially over the closely engaged surfaces of the annular hub and the annular core. Then the lubricant is dispersed radially over the annular core's corrugated planar surfaces by the combination of pressure exerted by the oil pump and centrifugal forces arising from the rotation of the annular core.

The present valve has penetrations in the shape of annulus sectors through its baseplate, its annular core, and its cover plate. When the valve is assembled and installed, the central axis of all those penetrations is the valve axis. The overall pattern of the valve's penetrations is such that there are four concentric circular arrays of penetrations in the baseplate, four in the annular core, and four in the cover plate, with the circular arrays also being centered on the valve axis when the valve is assembled and installed. There are N penetrations in each of the present valve's circular arrays, where N is the number of spark plugs dedicated to each of the engine's associated cylinders. The penetrations are sized, shaped, and situated so as to project an N-fold azimuthal symmetry about the valve axis, which means that the N penetrations in each circular array are congruent. In this specification, two annulus sectors are said to be congruent if and only if (1) they share a common central axis, (2) they have the same radial location and the same radial extent relative to their common axis, and (3) they have the same azimuthal extent relative to their common axis. With this definition, it is seen that two or more congruent penetrations can always be characterized as a circular array because they have the same radial location and are therefore the same distance from their common central axis. (It is noted that the cross-sectional shapes of the upper ports of the cover plate's penetrations may be modified so as to allow connection of other engine components, components such as spark plugs and gas flow lines.)

The circular arrays of penetrations in the valve's baseplate, its annular core, and its cover plate are identified with the ordinal numbers first, second, third, or fourth, in accordance with their radial distance from the valve axis, with the first circular arrays being closest to the valve axis and the higher-numbered circular arrays being progressively farther and farther from the valve axis. For example, the circular array in the valve's baseplate which is closest to the valve axis is referred to as the "baseplate's first circular array." As another example, the outermost circular array in the annular core is referred to as the "annular core's fourth circular array."

The circular arrays of penetrations in the valve's baseplate, its annular core, and its cover plate are referred to as "corresponding circular arrays" if they are identified by the same ordinal number. For example, the third circular array of the annular core, the third circular array of the baseplate, and the third circular array of the cover plate, are corresponding circular arrays.

The valve design is such that the penetrations in corresponding circular arrays of the valve's baseplate, its annular core, and its cover plate all have the same radial location, the same radial extent and the same azimuthal extent, meaning that the penetrations in corresponding circular arrays are congruent to each other. For example, the penetrations in the annular core's second circular array are not only congruent to each other, they are congruent to the penetrations in the second circular array of the baseplate and to the penetrations in the second circular array of the cover plate. However, the penetrations in non-corresponding circular arrays are not necessarily congruent to each other. For example, the penetrations in the baseplate's first annular array may not be congruent with the penetrations in the baseplate's fourth circular array or to the penetrations in the cover plate's third circular array, and so on. Further, the valve design is such that each penetration in the baseplate has the same fixed azimuthal location relative to the valve axis as one penetration in the cover plate and vice versa, thereby causing each baseplate penetration to be directly below (directly opposite) one cover plate penetration which is congruent to it. Two congruent penetrations that are fixedly set directly opposite each other in the baseplate and the cover plate constitute what is referred to herein as a "congruent penetration pair." Each penetration in the valve's baseplate is an element of one, and only one, congruent penetration pair, as is each of the penetrations in the valve's cover plate.

As the annular core rotates, its penetrations become aligned with, and spatially linked to, congruent penetration pairs in the valve's shell. The faces of the elements of a congruent penetration pair that are initially overlapped by the penetrations of the rotating annular core are referred to herein as "leading faces." Each time the annular core rotates through an angle of 360/N degrees, the N penetrations in any given circular array (first, second, third, or fourth) of the annular core will simultaneously align with the N congruent penetration pairs in the corresponding circular arrays of the baseplate and the cover plate. This simultaneous alignment of penetrations in corresponding circular arrays creates N symmetrically positioned channels (flow passages or ignition pathways) connecting the upper ports of the penetrations in one of the cover plate's circular arrays with the internal volume of the valve's associated cylinder.

Even though there is simultaneous alignment of penetrations within corresponding circular arrays, alignment of penetrations in non-corresponding circular arrays is not simultaneous because the leading edges of penetrations in the annular core's circular arrays are offset azimuthally. For example, as the annular core rotates, the penetrations in the first circular arrays become aligned before the penetrations in the second circular arrays, the penetrations in the second circular arrays become aligned before the penetrations in the third circular arrays, and the penetrations in the third circular arrays become aligned before the penetrations in the fourth circular arrays. Since the rotation of the annular core is directly linked to the rotation of the associated engine's crankshaft, the functional operations of the valve (opening and closing of ignition pathways and fuel, oxidant, and exhaust flow passages) are accurately synchronized with the reciprocating motion of the piston in the valve's associated cylinder, thereby enabling the timely execution of processes (intake, ignition, combustion, expansion, exhaust) constituting the associated engine's operating cycle.

Operation of the present valve involves forcing the rotation of the valve's annular core by means of a linkage between the annular core and the associated engine's crankshaft. That linkage maintains precise angular synchronism between the annular core's rotation and the crankshaft's rotation. This in turn synchronizes the annular core's rotation with the reciprocating motion of the piston in the valve's associated cylinder, which is also driven by the crankshaft. It is understood that the reciprocating motion of the piston must be precisely coordinated with execution of the processes constituting the engine's operating cycle.

The exact nature of the linkage between the valve's annular core and the engine's crankshaft is not part of this invention, but the linkages could be in the form of gears, timing belts, timing chains, synchronous motors, or combinations thereof, all of which are well-known from the prior art. However, regardless of the type of linkage used between an annular core and the associated engine's crankshaft, each 360-degree rotation of the crankshaft must force a rotation of exactly 360/N degrees for the annular core. This is because a two-stroke engine's operating cycle is executed once for each 360-degree rotation of the crankshaft and the engine's operating cycle must be executed once for each 360/N degree rotation of the valve's annular core.

Installation of the present valve on a target engine involves its connection to the target engine's block deck and to other apparatus. The upper ports of penetrations in the cover plate's first (innermost) circular array are connected to an external reservoir containing pressurized gaseous fuel; the upper ports of penetrations in the cover plate's second circular array are connected to an external reservoir containing pressurized gaseous oxidant; the upper ports of penetrations in the cover plate's third circular array support spark plugs; and the upper ports of penetrations in the cover plate's fourth (outermost) circular array are connected to an exhaust manifold. Therefore, the valve's first circular arrays—including the first circular array in the valve's baseplate, the first circular array in the valve's annular core, and the first circular array in the valve's cover plate—are all designated as "fuel arrays," and the alignment of fuel array penetrations opens N symmetrically positioned "fuel flow passages." Similarly, the valve's second circular arrays are designated as "oxidant arrays," and the alignment of oxidant array penetrations opens N symmetrically positioned "oxidant flow passages." The valve's third circular arrays are designated as "ignition arrays," and the alignment of ignition array penetrations opens N symmetrically positioned "ignition pathways." The valve's fourth circular arrays are designated as "exhaust arrays," and alignment of exhaust array penetrations opens N symmetrically positioned "exhaust flow passages."

As the valve's annular core rotates, its penetrations align with congruent penetration pairs in the shell, thereby forming, in a precise temporal sequence, channels which serve as (1) fuel flow passages that connect a fuel reservoir to the internal volume of the valve's associated cylinder, (2) oxidant flow passages that connect an oxidant reservoir to the internal volume of the valve's associated cylinder, (3) ignition pathways that expose spark plug electrodes to the fuel-oxidant charge within the valve's associated cylinder, and (4) exhaust flow passages that connect the internal volume of the valve's associated cylinder to the associated engine's exhaust manifold. (It is noted that the fuel and oxidant reservoirs will not be connected directly to the present engine's associated cylinders, but instead will be connected to pressure regulators which will decrease the pressures of the incoming gases to values that are appropriate for the desired engine power level.)

Azimuthal offset of the penetrations in the annular core's circular arrays determine the relative timing of their alignment with congruent penetration pairs in corresponding circular arrays of the shell. The combined azimuthal extent of the penetrations in any of the annular core's circular arrays and the congruent penetration pairs in the corresponding circular arrays of the shell determines the duration of the time (in degrees of crankshaft rotation between the beginning of penetration alignment (initial partial opening of flow passages or ignition pathways) and the end of penetration alignment (complete closing of flow passages or ignition pathways). The radial extent of the penetrations may be chosen independently their azimuthal extent in order to provide the required cross sectional area of the flow passages or ignition pathways formed by alignment of penetrations. This is a degree of flexibility that is not available with holes that have a cross-sectional shape that is not in the form of an annular sector.

The present invention offers several improvements over previously revealed automotive valves in general, and over the valve revealed in U.S. patent application Ser. No. 17/232,885 in particular. First, the N-fold azimuthal symmetry of penetrations in the present valve's baseplate, its annular core, and its cover plate, provides N ports for fuel and oxidant gases to enter the valve's associated cylinder, thereby promoting rapid in-cylinder mixing of the gases. This becomes increasingly important for engines with larger cylinder bores. Second, the present valve provides N ignition points for initiating combustion of the fuel and oxidant gases within a cylinder, thereby promoting more uniform, more rapid, and more efficient combustion. Again, this becomes increasingly important for engines with larger cylinder bores. Third, the present valve provides N exhaust ports, thereby reducing localized thermal loading and eliminating hot points produced by exhaust gases as they exit the cylinder. Fourth, the present valve provides accurate coordination of the associated engine's fuel and oxidant injection processes, its ignition process, and its exhaust removal process, thereby allowing the engine's operating cycle to be executed with temporal precision and maximum efficiency. Fifth, the present valve isolates spark plugs from the internal volume of the valve's associated cylinder except during those time intervals wherein the spark plugs are electrically activated as part of the engine's normal operating cycle. This last capability eliminates engine pre-fire events that are caused by hot points on the spark plug electrodes, thereby achieving the primary objective of the present invention.

Previous paragraphs imply that each valve has its own baseplate, its own cover plate, and its own outer wall. However, when valves of the type revealed herein are installed on an engine having multiple cylinders, several hub/core subassemblies may share a common baseplate and a common cover plate, with a single outer wall extending around the periphery of the shared baseplate. For clarity, discussions in this specification deal primarily with a completely autonomous valve whose hardware features are separately identifiable with respect to the hardware features of other valves installed on the associated engine's block. However, it is noted that a valve assembly comprising multiple hub/core subassemblies that share a common baseplate, a common cover plate, and a common outer wall constitutes an embodiment of the present invention and this embodiment is disclosed herein.

In some applications, the present valve will be installed on an engine which uses pre-mixed fuel and oxidant gases, in which case the fuel and oxidant arrays in the baseplate, the annular core, and the cover plate would be combined and their functions (fuel and oxidant injection) would be carried out by "fuel-oxidant arrays," which would be the first circular arrays in the baseplate, the annular core, and the cover plate.

Alignment of fuel-oxidant array penetrations would open N symmetrically positioned "fuel-oxidant flow passages." In this situation, there would only be three circular arrays of penetrations in the valve's baseplate, three in the valve's annular core, and three in the valve's cover plate. The arrays would be fuel-oxidant arrays, ignition arrays, and exhaust arrays.

DETAILED DISCUSSION OF THE INVENTION

Figure 1:
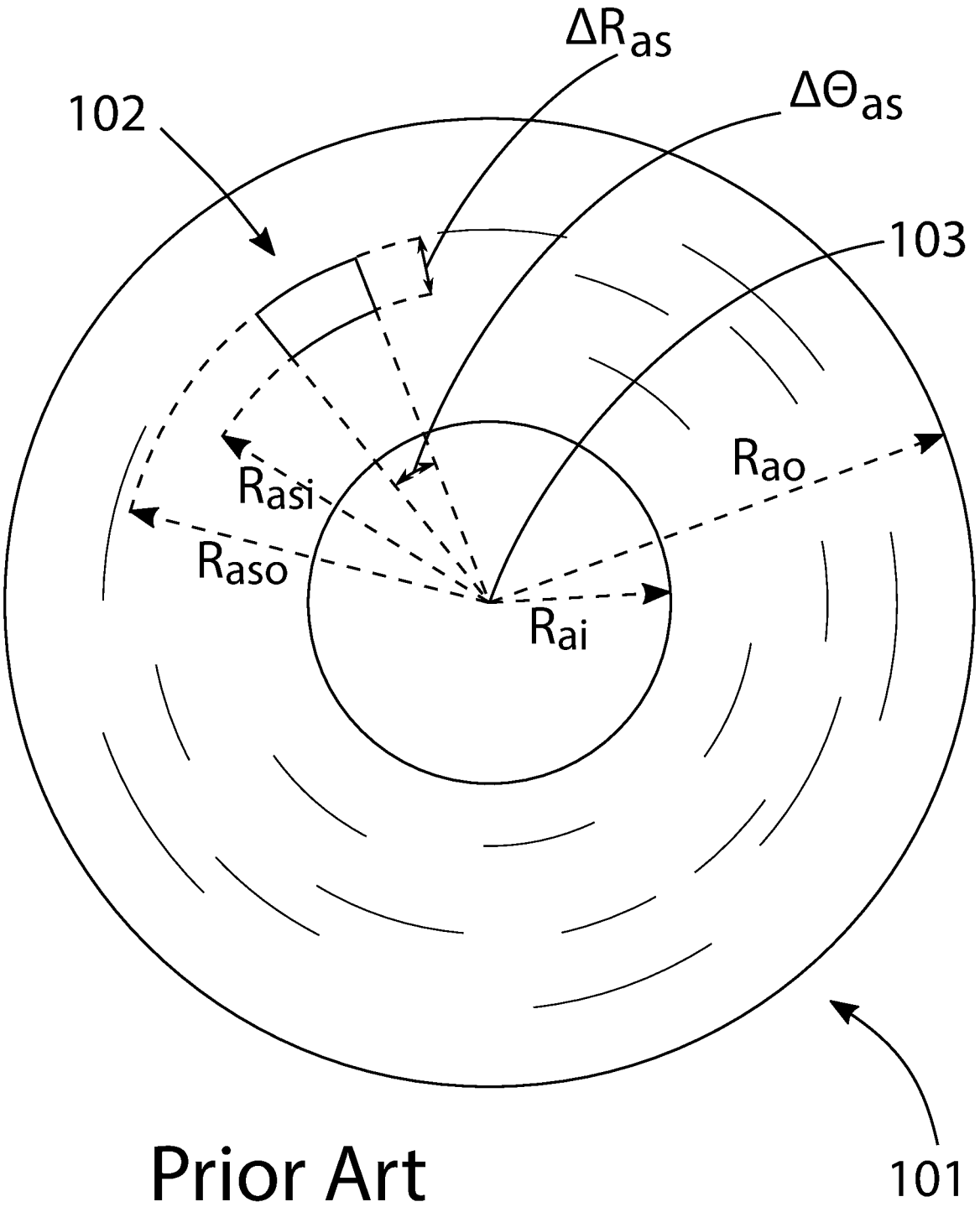
FIG. 1 shows the top view of an annular disk penetrated by a small annulus sector which has the same central axis as the larger annular disk.

This specification uses terms which have a technical meaning that may differ from the meaning assumed in everyday usage. The following paragraphs contain definitions and explanations of various terms and concepts with regard to the meaning intended herein.

Throughout this specification, features of the present valve are discussed with respect to a cylindrical coordinate system which is referred to herein as the "valve coordinate system." The axis of the valve coordinate system is the previously defined valve axis, or equivalently, the extended central axis of the valve's associated cylinder. In the valve coordinate system, the coordinates of a point P are indicated by the notation P(R, θ, Z), where R is the radial coordinate, θ is the azimuthal coordinate, and Z is the axial coordinate. The numerical value of the radial coordinate of the point P(R, θ, Z) is the distance R measured from the valve axis to the point P. The azimuthal coordinate of the point P(R, θ, Z) is the angle θ measured between two closed half-planes that include the valve axis, with one of the half-planes—the azimuthal reference plane—being tangent to the leading faces of one of the congruent penetration pairs in the shell's fuel arrays, and with the other half-plane containing the point P. The axial coordinate of the point P(R, θ, Z) is the distance Z measured from the associated engine's block deck, which is the axial reference plane, to the point P. It is noted that, since the valve's penetrations are arranged in an N-fold azimuthally symmetric pattern, there are N equivalent choices for the azimuthal reference plane. Regardless of which of these N planes is chosen as the azimuthal reference plane, proper execution of the associated engine's operating cycle requires that the annular core's fuel array penetrations initially begin to align with the congruent penetration pairs in the shell's fuel arrays precisely at the time when the piston in the valve's associated cylinder reaches its top-dead-center position. This particular azimuthal orientation of the annular core is considered to be zero degrees for the annular core's rotation. The operating cycle of the target (two stroke) engine is executed each time the engine's crankshaft rotates through 360 degrees (one piston upstroke and one piston downstroke), which corresponds to an annular core rotation of 360/N degrees.

The words "below" and "above" are used herein to refer to valve features that have the same radial and azimuthal shapes, dimensions, and locations, but have axial coordinates that are, respectively, less than or greater than another identical valve feature. For example, when considering the two shell penetrations constituting a penetration pair, the penetration in the valve's baseplate is below the penetration in the valve's cover plate, and the penetration in the valve's cover plate is above the penetration in the valve's base plate. The terms "inner surface" and "outer surface" refer to valve surfaces that are, respectively, closer to or farther from the valve's central axis. For example, the inner curved surface of the annular core is closer to the valve axis than its outer curved surface.

The word "annulus" is used herein to refer to a three-dimensional object or region of space whose boundaries are defined by two planar surfaces and two concentric cylindrical surfaces, with the central axis of the cylindrical surfaces being perpendicular to the two planar surfaces. The word "annular" is used herein to refer to an object or region of space which has the shape of an annulus.

As noted previously, when the present valve is installed on an engine block, the annular hub and the annular core share a common central axis, referred to as the valve axis, and the valve axis is coincident with the central axis of the associated cylinder when the valve is installed on the block deck of the associated engine.

The term "annulus sector" is used herein to refer to a portion of an annulus which is bounded azimuthally by two closed half-planes containing the axis of an annulus. The axis of an annulus sector is therefore the common axis of the two concentric curved surfaces which define the inner and outer radii of the annulus sector. As mentioned above, the penetrations through the various parts of the present valve have the shape and orientation of annulus sectors centered on the valve axis.

The radial location of an annulus sector relative to its central axis is defined by the radial coordinates of its inner and outer radii. In this specification, two annulus sectors having a common central axis are said to have the same radial location if their inner radii are equal to each other and their outer radii are equal to each other. Two annulus sectors having a common central axis are said to have different radial locations if the inner radius of a first annulus sector is greater than the outer radius of a second annulus sector. From these definitions, it is seen that two annulus sectors sharing a common axis have either the same radial location or they have a different radial location. The intermediate situation, wherein the inner radius of a first annulus sector is greater than the inner radius of a second annulus sector but less than the outer radius of the second annulus sector (partial radial overlap), is not dealt with in this specification. The "radial extent" of an annulus sector is the difference between the length of its outer radius and the length of its inner radius. It is noted that two annulus sectors that have the same radial location also have the same radial extent, but two annulus sectors that have the same radial extent do not necessarily have the same radial location. Similarly, the azimuthal location of an annulus sector is defined by the azimuthal coordinates of the two half-planes defining its azimuthal boundaries. Two annulus sectors are said to have the same azimuthal location relative to a common axis if they are azimuthally bounded by the same two closed half-planes, both of which extend from the common axis of the annulus sectors. The "azimuthal extent" of an annulus sector is the azimuthal angle between the two half-planes defining its azimuthal boundaries. Two annulus sectors are said to have the same azimuthal extent if the azimuthal angle between the planes defining their azimuthal boundaries are equal. It is noted that two annulus sectors that have the same azimuthal location also have the same azimuthal extent, but two annulus sectors that have the same azimuthal extent do not necessarily have the same azimuthal location.

As a clarification of the previous discussions, FIG. 1 shows the top view of annulus 101, which has central axis 103, inner radius Rai, and outer radius Rao. FIG. 1 also shows an annulus sector 102 which penetrates annulus 101, with annulus sector 102 having central axis 103, inner radius $R_{asi}$, outer radius $R_{aso}$, radial extent $\Delta R_{as}$, and azimuthal extent $\Delta\theta_{as}$.

The word "cylinder" is used herein to refer to a circularly cylindrical volume (three-dimensional region of space) contained within an engine block. In general, cylinders in piston engines have one stationary end and one moveable end, with the moveable end being the head of a piston which moves in a reciprocating manner within its associated cylinder. For engines that use valves of the type revealed herein, the stationary end of a cylinder is the baseplate of the cylinder's associated valve. When the valve is installed, the associated engine's block deck is coplanar with the lower planar surface of the valve's baseplate. That lower planar surface defines the stationary end of the cylinder. The constantly changing volume between the movable and stationary ends of a cylinder is referred to herein as the "internal volume" of the cylinder.

Thermodynamic processes, as related to internal combustion engines, are actions that involve changing the thermodynamic state variables (pressure, temperature, and molar density) of an engine's working fluid (fuel, oxidant, or combustion products). Thermodynamic processes are executed by performing thermodynamic work or by transferring thermal energy, with the work being done either on or by the working fluid, and with the transfer of thermal energy being either to or from the working fluid.

The term "operating cycle" is used herein to refer to an ordered sequence of thermodynamic processes that (1) are executed on or by an engine's working fluid (fuel, oxidant, and combustion products), (2) are executed repetitively within a piston engine's cylinders, (3) are executed concurrently with engine operation, and (4) are essential for engine operation. A piston engine's operating cycle is the means by which it converts the stored chemical energy of fuel and oxidant into mechanical energy.

The term "two-stroke engine" is used herein to refer to a piston engine wherein all of the processes constituting the engine's operating cycle are executed in each of the engine's individual cylinders through the action of a single movable piston, with the piston executing two full strokes within its associated cylinder for every cycle that is executed. The strokes executed by a piston in a two-stroke engine are (1) an "upstroke," wherein the internal volume of the piston's associated cylinder decreases, and (2) a "downstroke," wherein the internal volume of the piston's associate cylinder increases. For a two-stroke engine, two piston strokes and one complete engine operating cycle are executed during each 360-degree rotation of the engine's crankshaft.

As mentioned above, the target engine for deployment of the present valve is an external-compression, two-stroke, spark-ignition piston engine wherein the combustion process in each of the engine's cylinders is initiated by one or possible by multiple spark plugs. The target engine's operating cycle consists of (1) an exhaust process wherein exhaust gases are removed from a cylinder during piston upstroke, and (2) sequential intake, ignition, combustion, and expansion processes conducted during piston downstroke. For the target engine, these processes must be executed in a precisely coordinated manner. For some processes, errors of a few tenths of a degree of crankshaft rotation can have a negative impact on engine performance. The function of the present valve is to enable the processes constituting the target engine's operating cycle to occur in a timely manner, while at the same time preventing engine pre-fire events that are caused by hot points on the electrodes of spark plugs.

Figure 2A:
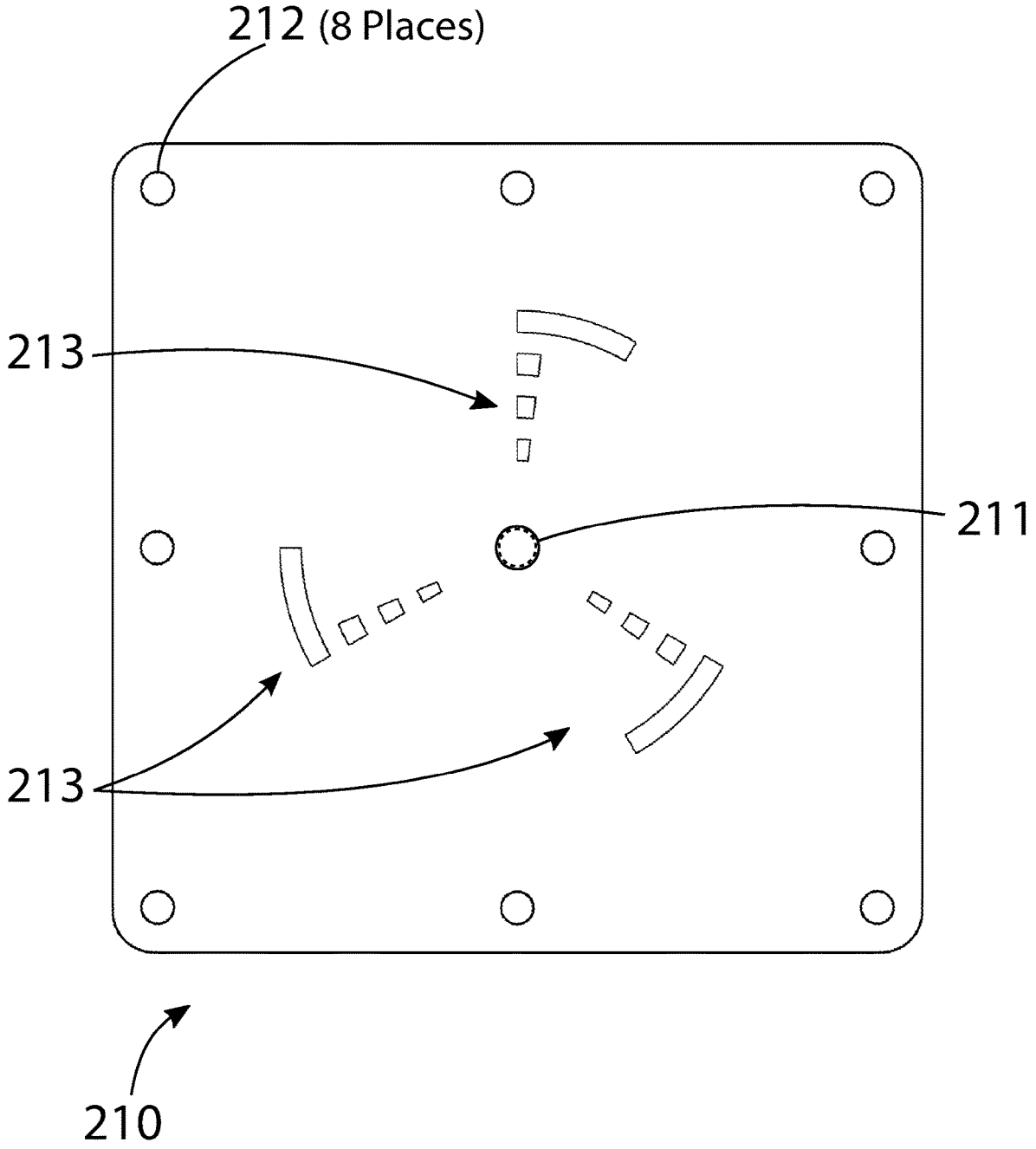
FIG. 2A shows the present valve's cover plate with penetrations set in 3-fold symmetry.

FIG. 2A shows a top view of the present valve's cover plate 210, whose features include: (1) a centrally located mounting hole 211 which accepts an oil-line fitting, (2) through mounting holes 212 which align with blind threaded holes (not shown in FIG. 2A) in the shell body's outer wall (not shown in FIG. 2A) when the valve is assembled and installed, and (3) cover plate penetrations 213, shown illustratively in 3-fold symmetry.

Figure 2B:
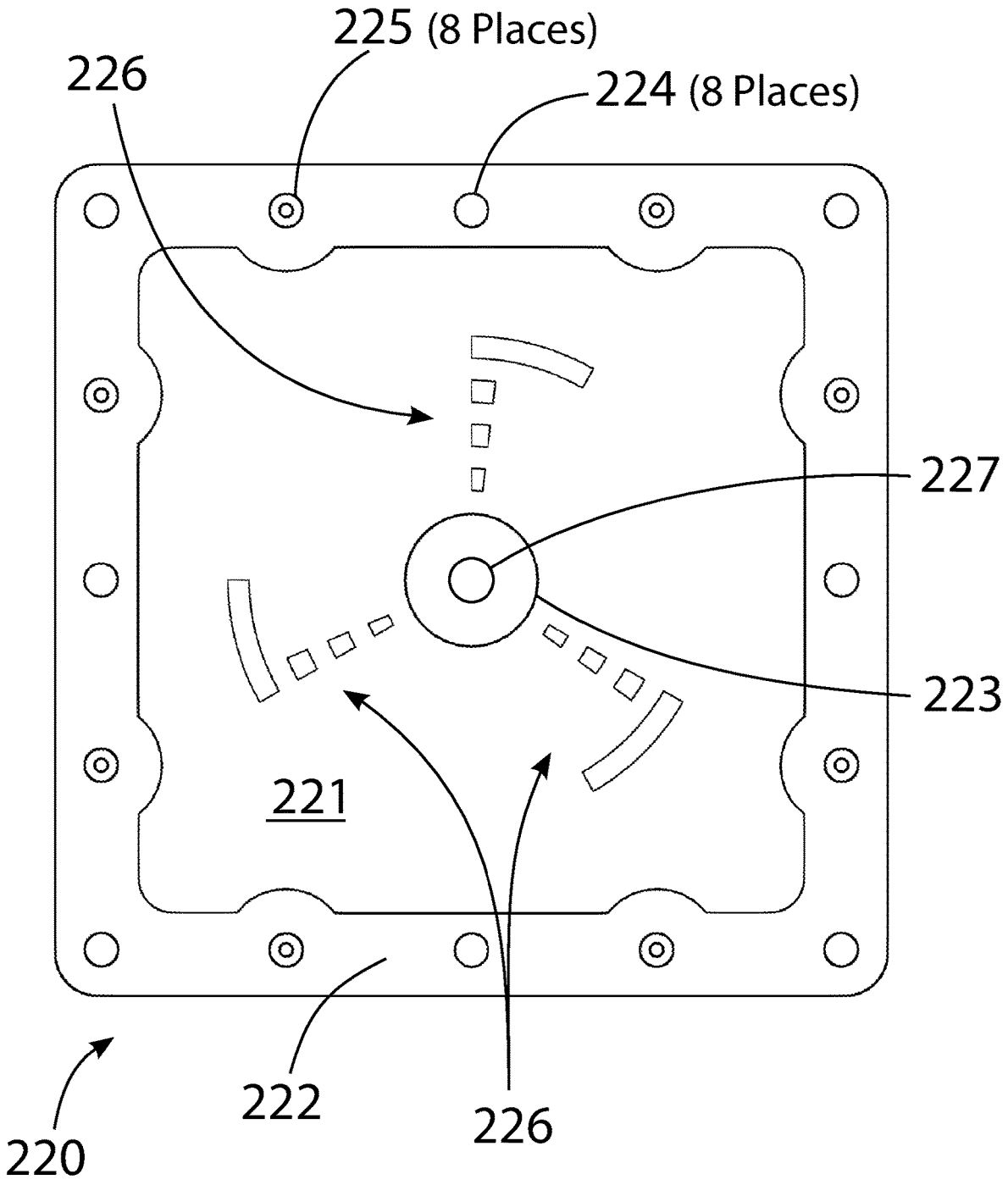
FIG. 2B shows the present valve's shell body with penetrations set in 3-fold symmetry.

FIG. 2B shows a top view of the present valve's shell body 220 whose features include: (1) a planar portion which is identified as the valve's baseplate 221; (2) an outer elevated region occupying the periphery of baseplate 221, with this outer elevated region identified as the valve's outer wall 222; (3) an annulus-shaped elevated region at the center of baseplate 221, with this annulus-shaped region identified as the valve's annular hub 223; (4) blind threaded holes 224 located in outer wall 222; (5) counter-bored through holes 225 passing down through outer wall 222 and baseplate 221;

and (6) baseplate penetrations 226, shown illustratively in 3-fold symmetry. Annular hub 223 has an internal volume identified by reference number 227.

Figure 2C:
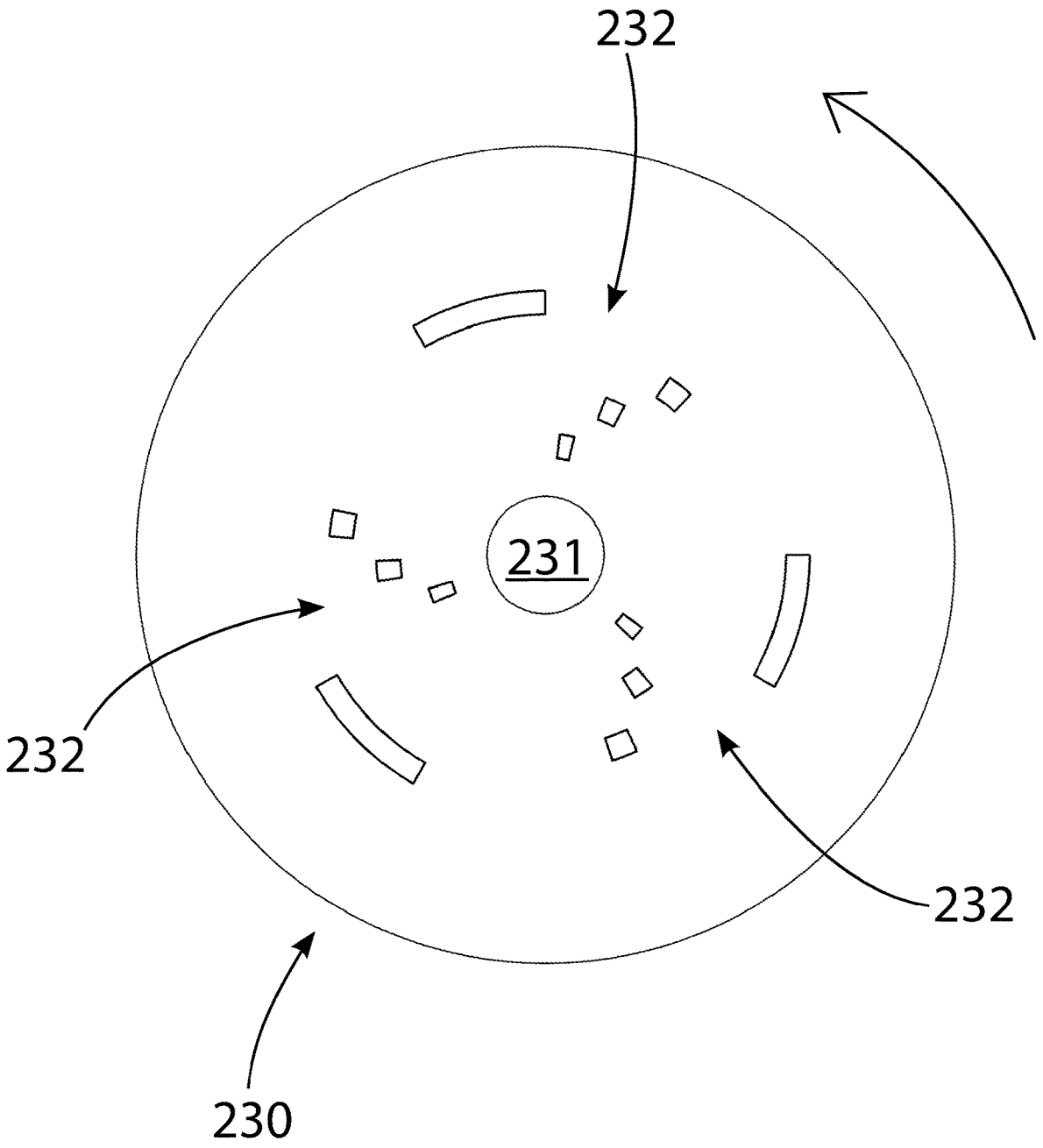
FIG. 2C shows the present valve's annular core with penetrations set in 3-fold symmetry.

FIG. 2C shows a top view of the present valve's annular core 230 whose inner curved surface becomes closely engaged with the outer curved surface of annular hub 223 (not shown in FIG. 2C) when the valve is assembled and installed. The annular core has a central volume 231 and annular core penetrations 232, shown illustratively in 3-fold symmetry.

Figure 2D:
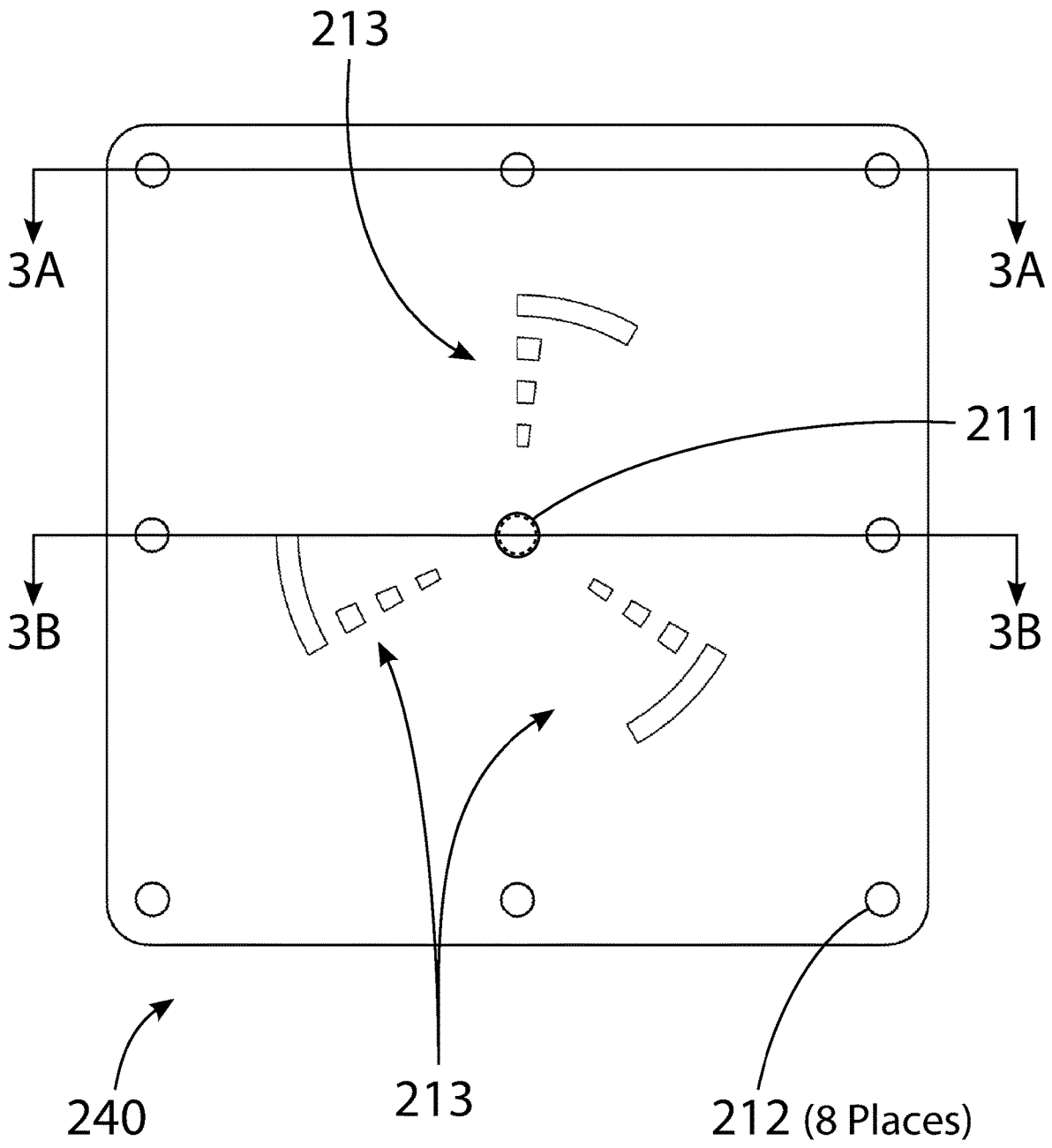
FIG. 2D shows a top view of the assembled valve with sections 3A-3A and 3B-3B identified.

FIG. 2D shows a top view of assembled valve 240, with section line 3A-3A marked along the centerline of a straight portion of outer wall 222 (not shown in FIG. 2D). FIG. 2D also shows section line 3B-3B marked across a transverse mid-plane of assembled valve 240.

Figure 3A:
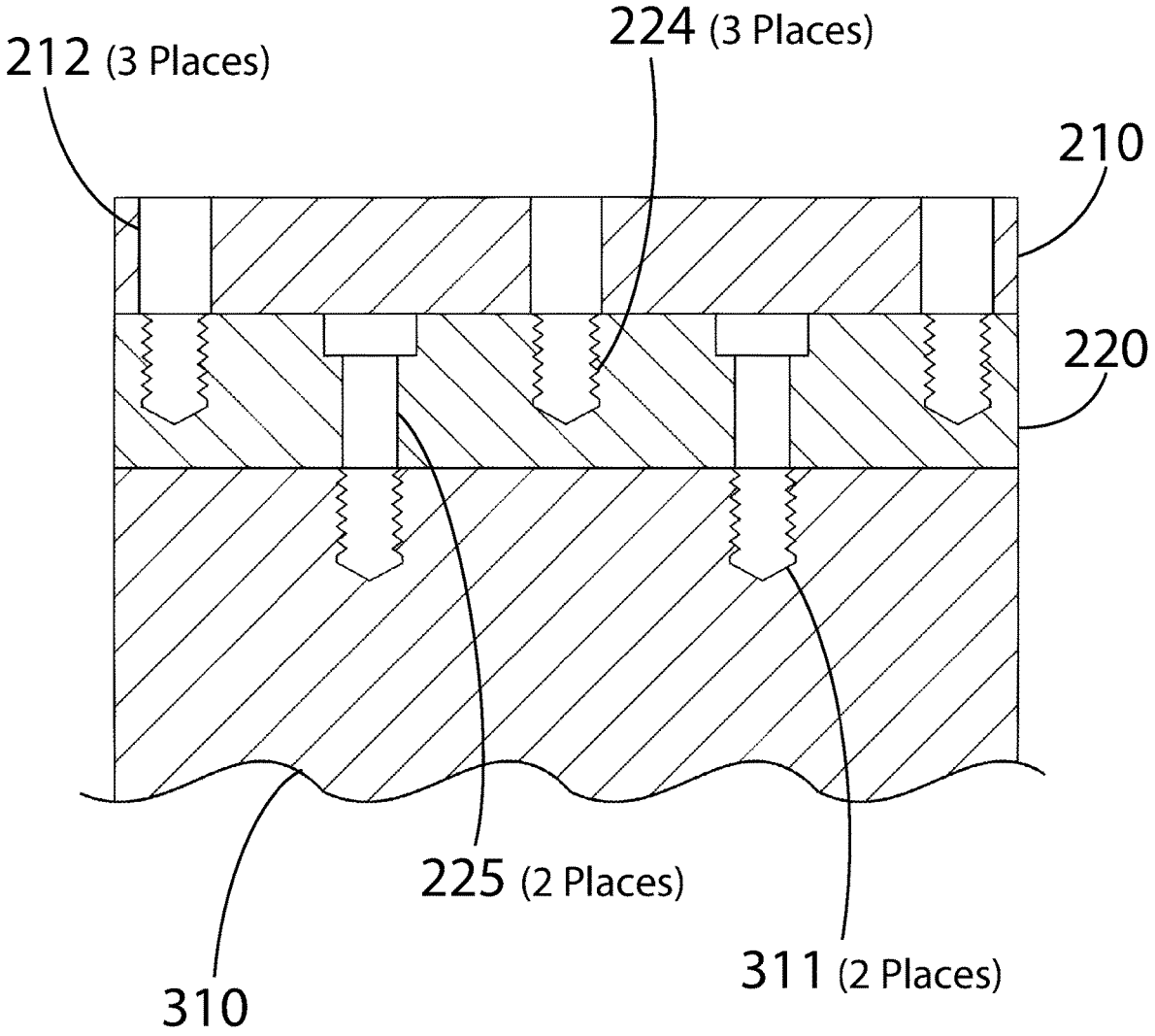
FIG. 3A shows a section view of the present valve when it is attached to the block deck of an associated engine, with the section taken along a linear center line of the outer wall.

FIG. 3A shows section view 3A-3A of the assembled valve as it would appear when installed on engine block 310, with the section taken along the centerline of a straight portion of outer wall 222 (not shown in FIG. 3A), as shown in FIG. 2D. Counter-bored through holes 225 in outer wall 222 align with blind threaded holes 311 in engine block 310 when the valve is assembled and installed, thereby facilitating the attachment of shell body 220 to engine block 310. Through holes 212 in cover plate 210 align with blind threaded holes 224 in outer wall 222 when the valve is assembled and installed, thereby facilitating attachment of cover plate 210 to shell body 220. Counter-bored through holes 225 make it possible to attach shell body 220 to engine block 310 independently of the attachment of cover plate 210 to shell body 220. Cover plate 210 can be attached to, or removed from, shell body 220 without removing shell body 220 from engine block 310.

Figure 3B:
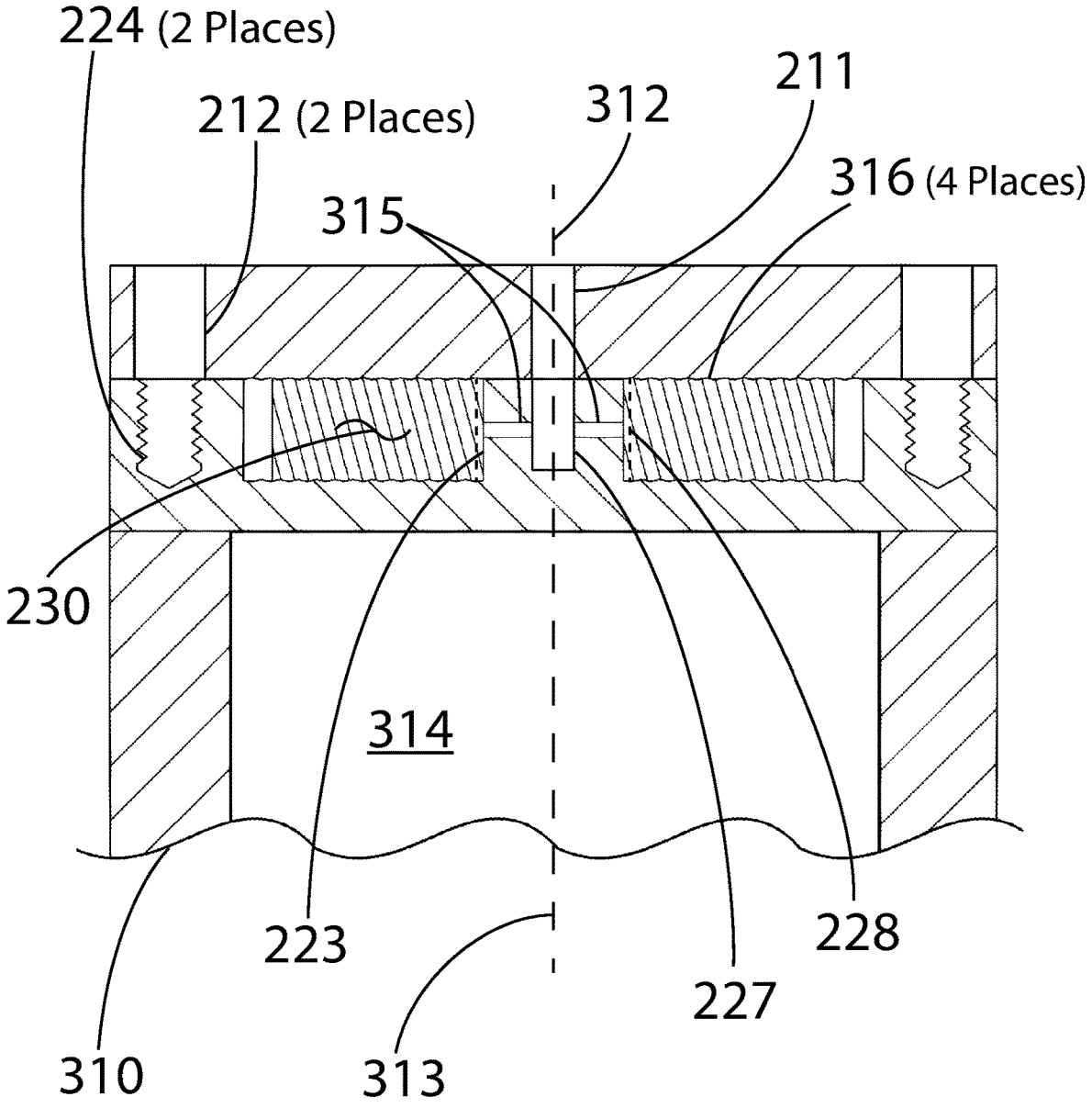
FIG. 3B shows a section view of the present valve when it is attached to the block deck of an associated engine, with the section taken along the valve mid-plane.
Figure 4A:
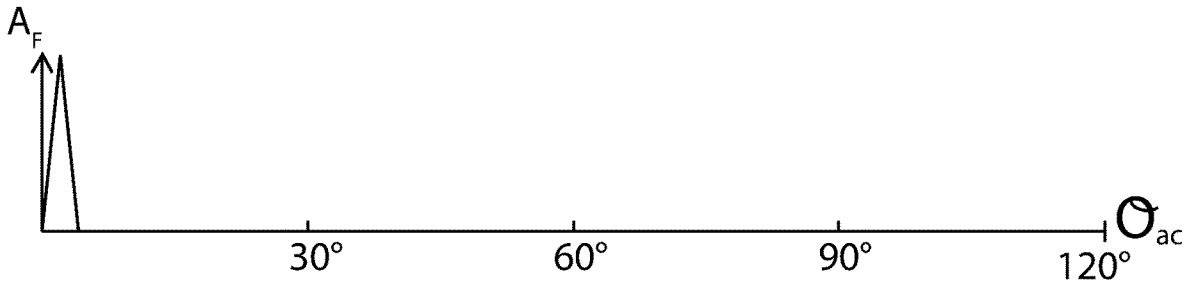
FIGS. 4A, 4B, 4C, and 4D show the relative cross-sectional areas of the aligned portion of overlapping shell and core penetrations for the fuel, oxidant, ignition, and exhaust circular arrays as a function of the annular core's azimuthal rotation, for the case of 3-fold azimuthal symmetry of the penetrations.
Figure 4B:
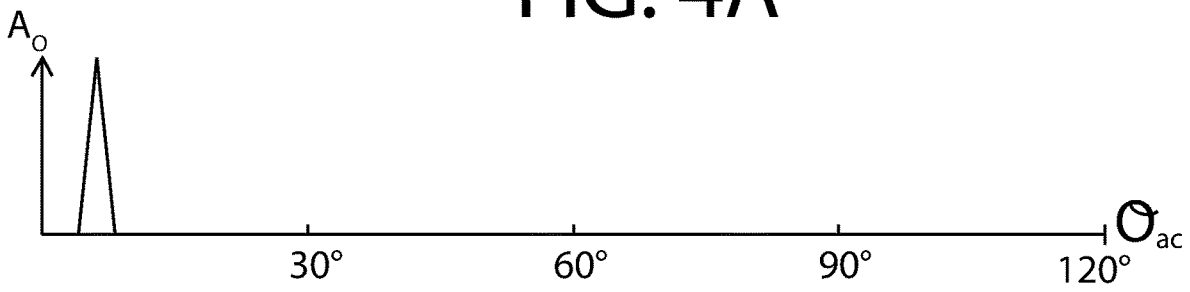
Figure 4C:
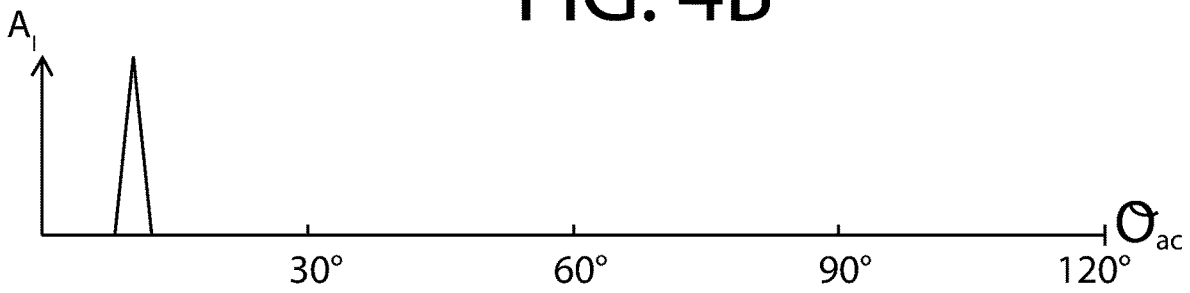
Figure 4D:
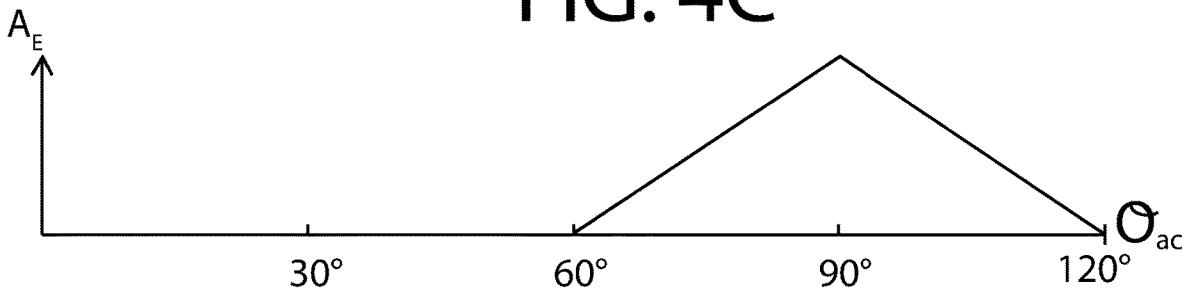

FIG. 3B shows section view 3B-3B of the assembled valve as it would appear when installed on engine block 310, with the section taken across a transverse mid-plane of the assembled valve, as shown in FIG. 2D. This view shows that the valve's annular hub 223 and its outer wall are made from the same piece of metal as the valve's baseplate. In this view, it is also seen that the planar surfaces of the baseplate, the cover plate, and annular core 230 have circularly corrugation 316 that are centered on valve axis 312.

Because of the relative locations of the shell body's counter-bored through holes 225 (not shown in FIG. 3B) and blind threaded holes 311 (not shown in FIG. 3B) in engine block 310, valve axis 312 coincides with central axis 313 of cylinder 314. Also, because of the relative locations of the cover plate's through holes 212 and the shell body's blind threaded holes 224, central mounting hole 211 in cover plate 210 (not labeled in FIG. 3B) overlays the central volume 227 of annular hub 223. This allows lubricating sealant driven by an oil pump to enter central volume 227 of annular hub 223 from central mounting hole 211 of cover plate 210. The lubricant is then forced through radial oil galleries 315 which carry the lubricant through the walls of annular hub 223 into axial grooves 228 in the outer curved surface of annular hub 223. The lubricant is dispersed axially over the closely engaged curved surfaces of annular hub 223 and annular core 230 by axial grooves 228 in the outer curved surface of annular hub 223. The lubricant is dispersed radially over the closely engaged corrugated surfaces of annular core 230, baseplate 221, and cover plate 210 by the combination of pressure exerted by the oil pump and centrifugal forces arising from the rotation of annular core [230].

FIG. 3B also shows that the upper surfaces of the shell body's annular hub and its outer wall are closely engaged with portions of the lower planar surface of the valve's cover plate. Since these seals are non-rotating, they are maintained as gasket seals.

FIG. 2A and FIG. 2B show that the fixed (non-rotating) penetration patterns in valve's baseplate and its cover plate are identical, thereby forming the congruent penetration pairs discussed in previous sections. FIG. 2C shows a nearly identical pattern for the penetrations in the valve's annular core, with the only difference being that the penetrations in the various annular core circular arrays are azimuthally offset relative to each other. This azimuthal offset causes the alignment of shell and core penetrations in different circular arrays to be delayed relative to one another by specific, pre-determined number of degrees of crankshaft rotation. Since the rotation of the crankshaft is responsible for the reciprocating motion of the piston in the valve's associated cylinder, the relative timing of the alignment of penetrations in the fuel, oxidant, ignition, and exhaust arrays is precisely synchronized with the movement of the piston within the valve's associated cylinder, as is required for proper execution of the engine's operating cycle.

When valves of the type revealed herein are installed on an engine with multiple cylinders, the fixed congruent penetration pairs in the valves' shell have, for each cylinder in the engine block, exactly the same N-fold azimuthal symmetry, the same azimuthal pattern, and the same azimuthal orientation relative to the azimuthal reference plane. Also, the penetrations in the valves' annular cores all have, for each cylinder, the same N-fold azimuthal symmetry and the same azimuthal pattern—a pattern which is different from the shell penetration patterns. The specific firing order required for the various cylinders in the valve's associated engine is achieved by having a different azimuthal orientation for each annular core relative to the rotation of the crankshaft. This is conceptually similar to fact that the lobes on a camshaft are at a different azimuthal orientation for each cylinder.

FIGS. 4A, 4B, 4C, and 4D show, respectively, the variation of the cross-sectional areas $A_F$, $A_O$, $A_I$, and $A_E$ of the valve's fuel flow passages, the valve's oxidant flow passages, the valve's ignition pathways, and the valve's exhaust flow passages, for the case of N=3 as is presented illustratively in the preceding figures. The variation of the cross-sectional areas is expressed along the horizontal axis as degrees of annular core rotation, $\theta_{AC}$, with zero degrees being associated with the top-dead-center position of the piston in the valve's associated cylinder. The maximum values of the cross-sectional areas are determined by both the radial extent and the azimuthal extent of the penetrations in the fuel, oxidant, ignition, and exhaust penetrations. The duration of the closed-open-closed transitions is determined by the azimuthal extent of shell and core penetrations in corresponding circular arrays. The relative timing of the various closed-open-closed transitions is determined by the azimuthal offset of penetrations in the annular core's fuel, oxidant, ignition, and exhaust arrays. It is note that the areas shown in FIGS. 4A, 4B, 4C, and 4D are relative. The peak values of the various cross sections are not actually equal to each other, but instead depend on the parameters mentioned above. In most valve applications, the radial extent of the penetrations in the various circular arrays will be different in order to create channel cross-sectional areas that are required for either (1) completely exposing the electrodes of a spark plug or (2) allowing appropriate quantities of fuel, oxidant, or exhaust gases to flow through a flow passage during its "open" time interval The functional operation of the present valve is now described in detail. Operation of the valve is driven by forces transferred from the associated engine's crankshaft to the valve's annular core, with the transfer executed by mechanical, electromechanical, or optomechanical linkages between the crankshaft and the annular core. These linkages ensure that the rotation of the valve's annular core is properly synchronized with the reciprocating motion of the piston in the valve's associated cylinder.

When the piston in the valve's associated cylinder reaches its top dead-center position, the N penetrations in the annular core's fuel array begin to rotate into alignment with the N congruent penetration pairs in the fuel arrays of the baseplate and the cover plate, thereby initiating injection of gaseous fuel into the valve's associated cylinder, with the injection being through N symmetrically positioned fuel flow passages. After a predetermined crankshaft rotation of a few degrees—a number of degrees determined by the azimuthal extent of the penetrations in the fuel arrays—the N penetrations of the annular core's fuel array rotate into full alignment with the N congruent penetration pairs in the fuel arrays of the baseplate and cover plate. Then as the crankshaft and the annular core continue to rotate and the piston continues to move downward from its top-dead-center position, the fuel array penetrations begin to misalign and they eventually become completely misaligned, thereby completing the process of fuel injection. As soon as the fuel array penetrations have become completely misaligned (closed), the N penetrations in the annular core's oxidant array begin to rotate into alignment with the N congruent penetration pairs in the oxidant arrays of the baseplate and cover plate, thereby initiating injection of gaseous oxidant into the valve's associated cylinder, with the injection being through N symmetrically positioned oxidant flow passages. After a predetermined crankshaft rotation of a few more degrees—a number of degrees determined by the azimuthal extent of the penetrations in the oxidant arrays—the N penetrations of the core's oxidant array rotate into full alignment with the N congruent penetration pairs in the oxidant arrays of the baseplate and the cover plate. Then as the crankshaft and the annular core continue to rotate and the piston continues its downward stroke, the oxidant array penetrations begin to misalign and eventually become completely misaligned, thereby completing the process of oxidant injection. As soon as the oxidant array penetrations have become completely misaligned (closed), the N penetrations in the annular core's ignition array begin to rotate into alignment with the N congruent penetration pairs of the ignition arrays in the baseplate and cover plate, thereby exposing the associated cylinder's N symmetrically positioned spark plugs to the fuel-oxidant charge that has entered the cylinder during the previous few degrees of crankshaft rotation. When the degree of alignment of the penetrations in the ignition arrays provides line-of-site connection between the electrodes of the N spark plugs and the internal volume of the valve's associated cylinder, the spark plugs are electrically activated, thereby initiating combustion of the fuel-oxidant charge in the cylinder. After ignition of the fuel-oxidant charge has occurred, the annular core continues to rotate, causing the penetrations in the ignition arrays to be partially, and then fully misaligned, thereby completing the ignition process. It is noted that the ignition process occurs at a predetermined azimuthal rotation of the annular core, a rotation that is determined by the combined azimuthal extent of the penetrations in the fuel, oxidant, and ignition arrays. When the ignition process occurs at about 10 or 15 degrees of crankshaft rotation past piston top-dead-center, very high combustion-product expansion ratios are available and high engine efficiencies can be achieved. After ignition of the fuel-oxidant charge, the combustion products continue to expand and to do useful work until the annular core has rotated 180/N degrees past its zero degree reference (beginning alignment of fuel array penetrations), at which point the piston in the valve's associated cylinder has reached its bottom-dead-center position and the piston's upstroke (exhaust stroke) begins. As piston upstroke begins, penetrations in the valve's exhaust arrays begin to align and exhaust gases begin to flow into the exhaust manifold. After the annular core has rotated 360/N degrees past the zero-degree reference, the piston has reached its top-dead-center position and all of the exhaust gases have been driven from the cylinder into the exhaust manifold. At this point, penetrations in the exhaust arrays have completely misaligned and the operating cycle is complete. From the above discussion, it is noted that piston downstroke occurs during a crankshaft rotation of 180 degrees, which corresponds to an annular core rotation of 180/N degrees. During piston downstroke, the processes of fuel intake, oxidant intake, fuel-oxidant ignition, and combustion-product expansion all occur sequentially, that is, with no temporal overlap. Piston upstroke is then a pure exhaust stroke that occurs during a crankshaft rotation of 180 degrees, which corresponds to an annular core rotation of 180/N degrees.

The present valve performs many demanding time-critical tasks as the associated engine's operating cycle is executed, tasks that cannot be performed by valves disclosed in the prior art. First, the present valve physically isolates the internal volume of the valve's associated cylinder from the spark plugs that initiate combustion within the cylinder until immediately before the spark plugs are electrically activated as part of the engine's normal operating cycle. This eliminates pre-fire events that are caused by hot points on the electrodes of the spark plugs, thereby achieving the primary objective of this invention. Second, the present valve provides for azimuthally symmetric injection of fuel and oxidant gases into its associated cylinder at N locations around the closed end of the cylinder. This produces rapid in-cylinder mixing of fuel and oxidant gases and ensures more complete fuel combustion. Third, the present valve enables azimuthally symmetric ignition of fuel and oxidant gases at N locations around the closed end of the cylinder. This facilitates more rapid and more uniform combustion of the fuel-oxidant gases and improves engine efficiency. It also causes the expanding combustion products to exert azimuthally symmetric forces on the piston head, thereby reducing wear on the walls of the valve's associated cylinders. Fourth, the present valve enables removal of exhaust gases from its associated cylinder at N azimuthally symmetric locations around the closed end of the cylinder. This reduces localized thermal loading caused by the hot exhaust gases as they exit the cylinder. Fifth, the continuous rotation of the present valve's annular core spreads the heat deposited by combustion products and exhaust gases across the entire closed end of the valve's associate cylinder, thereby eliminating engine pre-fire events caused by hot areas located near the lower ports of the exhaust flow passages. Finally, the present valve provides accurate relative and absolute temporal control of the opening and closing of gas flow passages and ignition pathways—control that is essential for optimal performance of the target engine.

Throughout this specification, the present valve has been discussed primarily in terms of its design for, and use with, a two-stroke engine which has two or more spark plugs (N=2, 3, 4, 5, . . . ) for each of its cylinders, with higher values of N being appropriate for engines with larger cylinder bores. It is obvious that a valve design can be created for use with an engine which has a single spark plug for each cylinder, in which case the fuel, oxidant, ignition, and exhaust arrays would be degenerate circular arrays, with each having only one penetration whose size, shape, and location would accomplish the gas flow and ignition control functions discussed above. One penetration is a degenerate circular array because the radius of the penetration's inner (or outer) curved surface defines a circle whose center is on the valve axis. The symmetry of a circular array with only one penetration is the degenerate 1-fold symmetry, as it would take 360/1 degrees of azimuthal rotation to reproduce the original penetration pattern.

As an example, if one considers a relatively small spark-ignition piston engine whose cylinders are less than 8 or 10 centimeters in diameter, an engine design with one spark plug might be appropriate, with the spark plug being offset from the valve axis so as to accommodate the present valve design, which has a lubrication source centered on the valve axis. In that case, there would be only one congruent penetration pair for fuel injection, one for oxidant injection, one for ignition, and one for exhaust removal. The annular core would sequentially create one fuel flow passage, one oxidant flow passage, one ignition pathway, and one exhaust flow passage each time it rotated through 360 degrees, and there would be one 360-degree rotation of the annular core for each 360-degree rotation of the crankshaft.

With the recognition that N-fold azimuthal symmetry includes the degenerate symmetry of N=1, the preferred embodiment of the present invention may be extended to include a valve design which is suitable for an engine that has N spark plugs per cylinder, with N=1, 2, 3, 4, . . . . Disclosure of the present invention in the accompanying claims is presented in terms of a valve which can be used with an engine having N spark plugs (N=1, 2, 3, 4, . . . ) associated with the ignition process in each of the engine's cylinder. The value of N for any particular engine is chosen by the engine designer so as to be appropriate for the cylinder bore of the engine, with larger values of N chosen for larger cylinder bores.

What is claimed is:

1. A valve designed for installation on the block of a spark-ignition piston engine; with the installation of said valve on said block being facilitated by the presence of blind threaded holes in said block, and with there being one of said valves installed on said block for each cylinder in said block; and with said valve comprising a) a shell which is fixed in position with respect to surrounding engine structure when said valve is assembled and installed; with said shell comprising i) a shell body which is fabricated from a single piece of metal, with said shell body having features which include (1) an annular hub whose axis, referred to herein as the valve axis, is coincident with the axis of said valve's associated cylinder when said valve is assembled and installed; with said annular hub having oil galleries passing radially from its inner curved surface to its outer curved surface; and with said oil galleries coupled to axial grooves in the outer curved surface of said annular hub; and (2) a baseplate which fixedly supports said annular hub, with said baseplate's lower planar surface being closely engaged with said block when said valve is assembled and installed; and with said baseplate's upper planar surface having circular corrugations that are centered on said valve axis; and with said baseplate having four concentric circular arrays of penetrations; and with each of said baseplate's circular arrays being centered on said valve axis; and with each of said baseplate's circular arrays consisting of N congruent penetrations situated so as to project an N-fold azimuthal symmetry about said valve axis, wherein N is a positive integer equal to the number of spark plugs used to initiate combustion in said valve's associated cylinder; and (3) an outer wall which encompasses the periphery of said baseplate; and with said outer wall having blind threaded holes; and with said outer wall having counter-bored through holes which align with said blind threaded holes in said block when said valve is installed, thereby facilitating attachment of said shell body to said block; and ii) a cover plate whose lower planar surface becomes closely engaged with the upper planar surfaces of said outer wall and said annular hub when said valve is assembled; and with said cover plate's lower planar surface having circular corrugations that are centered on said valve axis when said valve is assembled; and with said cover plate having features which include (1) through holes which align with said blind threaded holes in said outer wall when said valve is being assembled, thereby facilitating the attachment of said cover plate to said shell body; and (2) a central mounting hole which overlays said annular hub's central volume when said cover plate is attached to said shell body; and with said central mounting hole fabricated so as to accept an oil-line fitting which facilitates the injection of lubricant into said annular hub's central volume; and (3) four concentric circular arrays of penetrations, with each of said cover plate's circular arrays being centered on said valve axis when said valve is assembled; and with each of said cover plate's circular arrays consisting of N congruent penetrations situated so as to project an N-fold azimuthal symmetry about said valve axis when said valve is assembled; and with each of said cover plate's penetrations being radially and azimuthally situated so as to be one element of a congruent penetration pair whose second element is a penetration in said baseplate when said valve is assembled; and with the upper ports of each of the penetrations in said cover plate's first circular array being connected to a supply of pressurized gaseous fuel when said valve is assembled and installed; and with the upper ports of each of the penetrations in said cover plate's second circular array being connected to a supply of pressurized gaseous oxidant when said valve is assembled and installed; and with the upper ports of each of the penetrations in said cover plate's third circular array supporting and fixedly holding a spark plug when said valve is assembled and installed; and with the upper ports of each of the penetrations in said cover plate's fourth circular array being connected to an exhaust manifold when said valve is assembled and installed; and b) an annular core which is rotatable within said shell when said valve is assembled; with said annular core's inner curved surface being closely engaged with said annular hub's outer curved surface when said valve is assembled; and with the axis of rotation of said annular core being coincident with said valve axis when said valve is assembled; and with the rotation of said annular core driven by linkages to the crankshaft of said valve's associated piston engine when said valve is assembled and installed; and with said annular core's lower planar surface having circular corrugations that are centered on said valve axis when said valve is assembled; and with the circular corrugations on said annular core's lower planar surface being closely engaged with the circular corrugations on said baseplate's upper planar surface when said valve is assembled; and with said annular core's upper planar surface having circular corrugations that are centered on said valve axis when said valve is assembled; and with the circular corrugations on said annular core's upper planar surface being closely engaged with the circular corrugations on said cover plate's lower planar surface when said valve is assembled; and with said annular core having features that include i) four concentric circular arrays of penetrations; with each of said annular core's circular arrays being centered on said valve axis when said valve is assembled; and with each of said annular core's circular arrays consisting of N congruent penetrations situated so as to project an N-fold azimuthal symmetry about said valve axis when said valve is assembled; and with the penetrations in each of said annular core's circular arrays being congruent to the penetrations in corresponding circular arrays in said baseplate and said cover plate when said valve is assembled; and with the leading edges of the penetrations in each of said annular core's circular arrays being azimuthally offset relative to the leading edges of penetrations in said annular core's other circular arrays; and with the azimuthal offset of said annular core's penetrations ensuring timely opening and closing of fuel flow passages, oxidant flow passages, ignition pathways, and exhaust flow passages, thereby effecting precise temporal sequencing of the processes constituting said engine's operating cycle.

2. A valve as described in claim 1; with said valve having three circular arrays of penetrations in its baseplate, three circular arrays of penetrations in its annular core, and three circular arrays of penetrations in its cover plate; and with the alignment of penetrations in said valve's first circular arrays opening fuel-oxidant flow passages that connect a supply of premixed fuel and oxidant gases to the internal volume of said valve's associated cylinder; and with the alignment of penetrations in said valve's second circular arrays opening ignition pathways that connect spark plugs to the internal volume of said valve's associated cylinder; and with the alignment of penetrations in said valve's third circular arrays opening exhaust flow passages that connect an exhaust manifold to the internal volume of said valve's associated cylinder.

3. A valve assembly designed for installation on the block of a spark-ignition piston engine that has multiple cylinders; with said valve assembly comprising a number of annular-hub/annular-core subassemblies wherein the number of said annular-hub/annular-core subassemblies is equal to the number of cylinders in said block; and with the axis of each of said annular-hub/annular core subassemblies coinciding with the axis of one of said cylinders when said valve assembly is installed on said engine block; and with said annular-hub/annular-core subassemblies sharing a common baseplate and a common cover plate and with a single outer wall encompassing the periphery of said base plate; and with the rotation of each of said annular cores about its associated annular hub providing ignition control and fuel, oxidant, and exhaust gas flow control for its associated cylinder in the manner of the valve described in claim 1.

* * * * *